US005137303A

United States Patent [19]

Goade et al.

[11] Patent Number: 5,137,303

[45] Date of Patent: Aug. 11, 1992

[54] SYSTEM FOR VISUALLY CONCEALING PRINT

[75] Inventors: Ronnie E. Goade, Edmond, Okla.; Peter L. Kreitzer, Waukesha, Wis.

[73] Assignees: Glenroy, Inc., Menomonee Falls, Wis.; Stik/Strip, Inc., Edmond, Okla.

[21] Appl. No.: 720,973

[22] Filed: Jun. 25, 1991

[51] Int. Cl.[5] ..... B42D 15/00

[52] U.S. Cl. ..... 283/94; 283/904; 283/901

[58] Field of Search ..... 283/82, 94, 901, 904; 235/487, 488

[56] References Cited

U.S. PATENT DOCUMENTS 4,511,908 4/1985 Small ..... 283/95 X
4,849,618 7/1989 Namikawa et al. ..... 283/904 X
4,863,196 9/1989 Ohnishi et al. ..... 283/904 X
4,897,533 1/1990 Lyszczarz ..... 283/904 X

*Primary Examiner*—Mark Rosenbaum
*Assistant Examiner*—Willmon Fridie, Jr.
*Attorney, Agent, or Firm*—Dunlap, Codding & Lee

[57] ABSTRACT

A laminated card comprising a substrate and a card base. Carbon containing information such as a bar code is printed on the card base. A non-carbon coloring is applied to the substrate. A sealant is applied over the non-carbon coloring. The substrate is disposed on the card base with the sealant adjacent the card base and with the non-carbon coloring covering the carbon containing information for visually concealing the carbon containing information in this position, the substrate is secured to the card.

15 Claims, 2 Drawing Sheets

SYSTEM FOR VISUALLY CONCEALING PRINT

FIELD OF THE INVENTION

The present invention relates to a laminated card where a substrate having a non-carbon coloring thereon is secured to a card base having carbon containing information thereon whereby the non-carbon coloring covers and conceals the carbon containing information, and wherein a sealant is applied over the substrate and over the non-carbon coloring before laminating the substrate to the card base.

DETAILED DESCRIPTION OF THE DRAWINGS

The ability to transport and utilize information greatly expanded with the advent of the computer and more recently, techniques have developed which allow computers to receive and use printed information. An example of this is the bar code which is a code consisting of a group of printed and variously patterned bars and spaces and sometimes numerals that is designed to be scanned and read into a computer memory as identification for the object it labels.

In many cases where printed information is used, it is desirable or even necessary that the information is visually concealed such that one may not duplicate or read the information merely by looking at it. For example, a security clearance card or a charge card preferably contains information which is not readily ascertainable or reproducible. One prior method of concealing printed information was to apply a strip of opaque coating to a substrate and then laminate the substrate to a card base such that the opaque coating covered the printed information on the card base. The opaque coating was generally a material which could be penetrated by an infrared scanner, but stopped visible light. One problem with this method was that the opaque coating did not stick to the printed information, so one could peel up the substrate and the information on the card base was revealed.

The term "laminated card" as used herein is not intended to limit the present invention to any particular structure such as a credit card or security card or other card like structures. The term "card base" is used herein to mean a base structure having a surface with carbon containing information printed thereon and the term "card base" is not intended to limit the present invention to any particular structure such as a credit card or security card or other card like structure, or to limit the present invention to any particular material of construction. The term "laminated" as used herein merely refers to a product made by uniting two or more layers such as by adhesively connecting such layers. While the present invention is described herein as using a bar code as an example of carbon containing information which may be concealed, it should also be noted that a bar code is just one example of information which may be used with the present invention and that the present invention is intended to include any information which one may desire to visually conceal.

Figure 1:
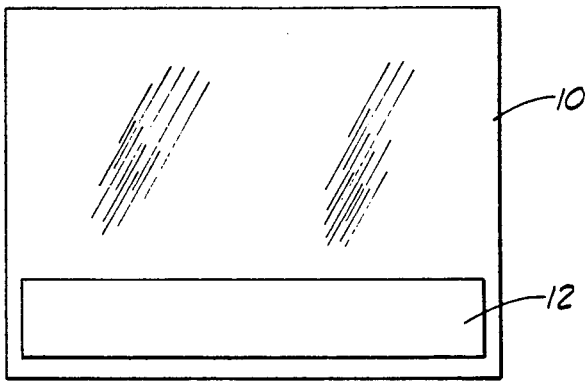
FIG. 1 is a top plan view of a substrate with a band of non-carbon coloring applied thereto used for making a laminated card in accordance with the present invention, the substrate being shown in FIG. 1 before a sealant has been applied thereto.

Shown in FIG. 1 is a substrate 10. The substrate 10 preferably is made of a transparent material such as polyethylene terephthalate. The substrate 10 may be any thickness, however, it has been found most useful to use a substrate 10 having a thickness of about 4 mils, when producing laminated cards such as credit cards or identification cards. A material suitable for making the substrate 10 may be purchased from ICI Americas Inc. Films Division of Wilmington, Del. 19897 under the product name #505 polyester.

The substrate 10 has a first side and a second side. A band of non-carbon coloring is applied to the first side of the substrate 10. As used in the specification and claims, the noncarbon coloring relates to one or more inks, usually solvent based inks, blended to form a color which does not contain a carbon black pigment. The band 12 shown in FIG. 1 is in the shape of a rectangle, but the band 12 may be in any shape and may be in more than one color. The band 12 may be applied to the substrate 10 by any means, but it is generally preferable to use flexography or silk screening to apply it. If the band 12 is to conceal printed information, then the band 12 should be sufficiently opaque to substantially block the passage of visual light and visually conceal the carbon containing information.

Figure 2:
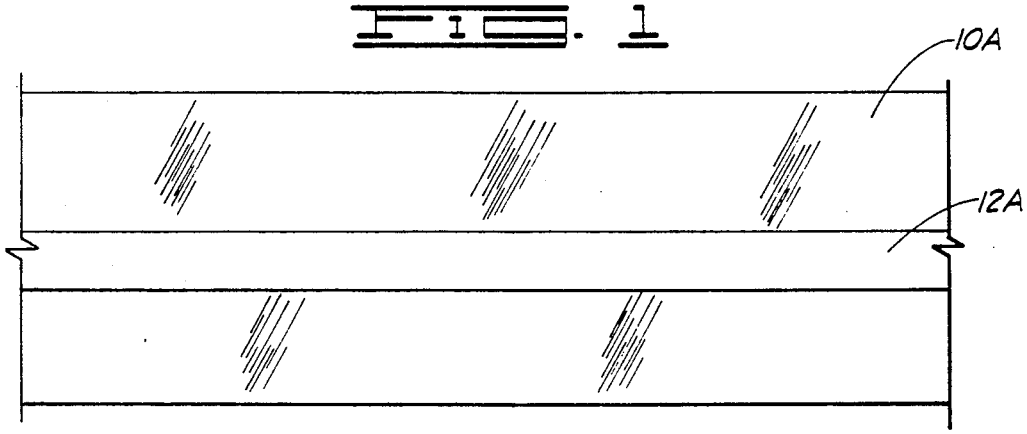
FIG. 2 is a top plan view of a segment of a modified substrate, similar to FIG. 1, but showing the substrate in the form of a continuous strip with a continuous strip of non-carbon coloring applied thereto.

FIG. 2 shows a continuous band of non-carbon coloring **12*a* which is coated down the length of a modified substrate 10*a* in the form of a continuous strip. With the embodiment shown in FIG. 2, the substrate 10*a*** may be supplied in long continuous rolls and then later cut to the desired size.

Figure 3:
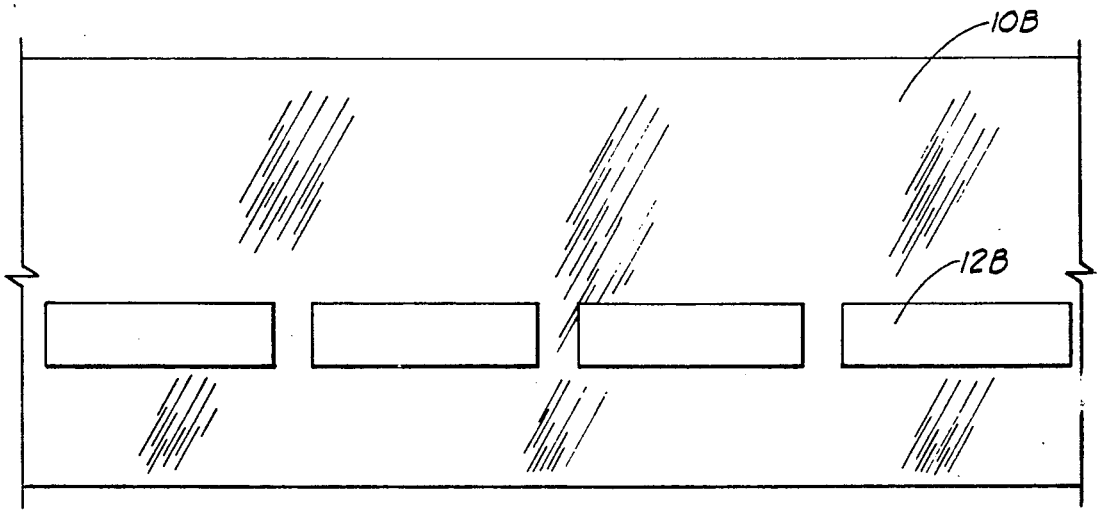
FIG. 3 is a top plan view of a segment of a modified substrate with separate shapes of non-carbon coloring applied thereto.

FIG. 3 shows an example of a modified substrate **10*b* in the form of a continuous strip with individual shapes or bands of non-carbon coloring 12*b* (only one band 12*b* being indicated with a specific reference numeral in FIG. 2) applied on the substrate 10*b***.

Figure 4:
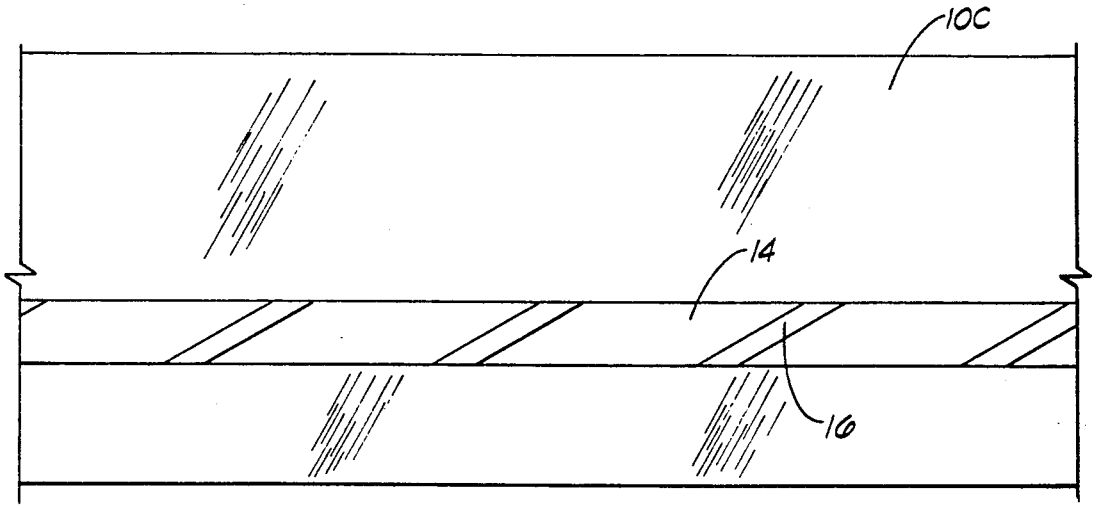
FIG. 4 is a top plan view of a fragment of another modified substrate in the form of a continuous strip with two colors of non-carbon coloring having been applied thereto.

FIG. 4 shows an example of a modified substrate **10*c* in the form of a continuous strip having two non-carbon colors 14 and 16** applied thereon.

Figure 5:
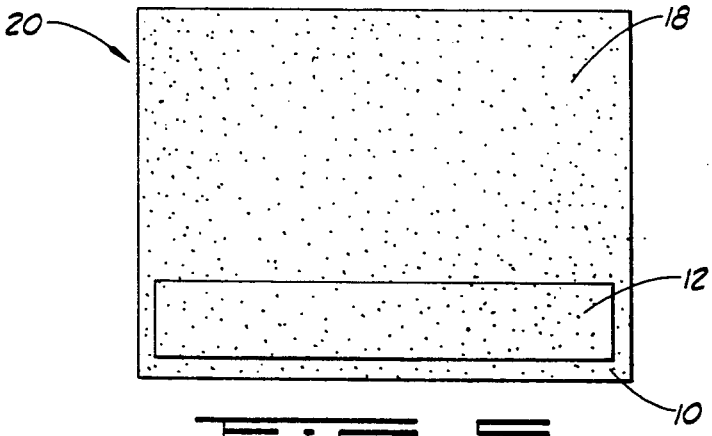
FIG. 5 is a top plan view of the substrate of FIG. 1 with a sealant applied over and on top of the substrate and the non-carbon coloring.

FIG. 5 shows the substrate 10 and the band of non-carbon coloring 12 with a sealant 10 applied thereover. The sealant 18 is applied over and on top of the band of non-carbon coloring 12, and over and on top of the first side of the substrate 10.

Figure 6:
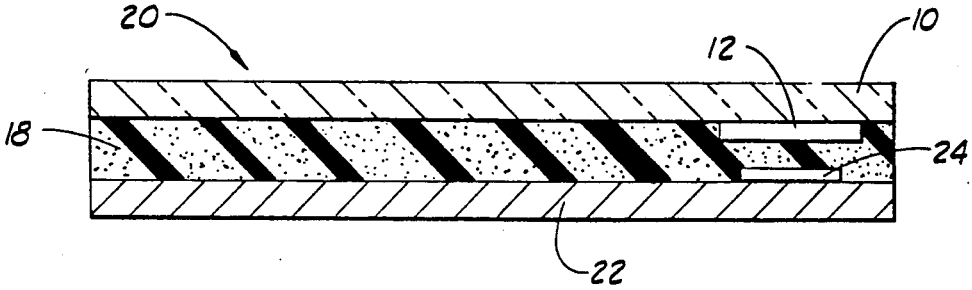
FIG. 6 is an enlarged cross-section of a laminated card constructed of the substrate of FIG. 5 and a card base having carbon containing information printed thereon.

FIG. 6 is an enlarged cross-section of a laminated card 20 constructed in accordance with the present invention. The laminated card 20 comprises a card base 22 having a first side and a second side and having carbon containing information 24 printed on the first side thereof. The card base 22 is rectangular shaped and is about the same size and shape as the substrate 10 shown in FIG. 1. The card base 22 may be constructed of any material such as metal, glass, cardboard or plastic.

The substrate 10 with t he non-carbon opaque coloring 12 applied thereon and with the sealant 18 applied over and on top of the non-carbon coloring 12 is disposed on the card base 22 with the first side of the substrate 10 being disposed adjacent the first side of the card base 22 and positioned so that the non-carbon opaque coloring 12 covers the carbon containing information 24. In this position, the substrate 10 is laminated to the card base 22 such as with heat and pressure.

The sealant 18 may be any substance which will bond with the substrate 10, the non-carbon coloring 12 and the card base 22 sufficiently to prevent the removal of the non-carbon coloring 12 without substantially destroying the printed information 22. The sealant 18 is an adhesive which will permit the laminating of the substrate 10 to the card base 22. It has been found that suitable sealant 18 may be made using a copolymer such as ethylene ethyl acrylate copolymer preferably applied about 6 mils thick. Ethylene ethyl acrylate copolymer is commercially available from the Union Carbide Company as product #UC6169EEA.

The non-carbon coloring 12 is sandwiched between the sealant 18 and the substrate 10 and is positioned and adapted to prevent one from seeing the carbon containing information 24 with the naked eye. Since the non-carbon coloring 12 is between the sealant 18 and the substrate 10, the non-carbon coloring 12 is protected from the outside by the substrate 10. The substrate 10 is secured to the card base 22 containing the carbon containing information 24 by the sealant 18. In particular, the carbon containing information itself and the surface immediately surrounding it is secured to the substrate 10. In this way, if the substrate 10 is removed, the carbon containing information will be substantially destroyed.

The process for preparing the invention may include priming the substrate 10 to enhance the adhesive connection between the sealant 18 and the substrate 10. Many suitable primers are commercially available and commonly known in the art, however, a water based primer is preferred. To substrate 10 a non-carbon coloring 12 is applied. Then it is corona treated and primed to enhance the bonding capabilities of the sealant layer 18. The non-carbon opaque coloring 12 is applied to the substrate 10 using any suitable method. Flexography and silk screening is recommended as a common and adequate method for applying the non-carbon opaque coloring 12 to the substrate 10. Once the non-carbon opaque coloring 12 has been applied, then the sealant 18 is applied. In this way, the non-carbon coloring 12 is covered by the sealant 18.

The substrate 10 with the non-carbon opaque coloring 12 and sealant 18 applied thereto then is applied to the card base 22 having carbon containing information 24 thereon. It is preferred that prior to applying the substrate 10 to the card base 22, that the substrate 10 is again corona treated and most preferably to 50–54 dynes. This postcorona treating enhances the bonding capabilities of the substrate 10 with the sealant 18 thereon. The substrate 10 then is secured or aminated to the card base 22 having the carbon containing information 24 by a suitable method which may be dictated by the type of sealant 18 used. For example, if ethylene ethyl acrylate copolymer is used (as described above), the substrate 10 is preferably applied by placing the substrate 10 on the card base 22 and then applying heat and pressure sufficient to cause the sealant 18 to bond the substrate 10 to the card base 22.

Once the substrate 10 is secured in place, the carbon containing information 24 is hidden from the naked eye. However, since the carbon containing information 24 is printed in an ink containing carbon black pigment and the non-carbon coloring 12 is a non-carbon containing coloring, an infrared scanner can read through the non-carbon coloring 12 to interpret the carbon containing information 24. Advantageously, the substrate 10 is secured to the card base 22 including that area of the card base 22 where the carbon containing information is contained such that the substrate 10 may not be removed without substantially destroying the carbon containing information.

Changes may be made in the various components and assemblies described herein or in the steps or sequence of the steps described herein without departing from the spirit and scope of the invention as defined in the following claims.

What is claimed is:

1. A laminated card, comprising:

a substrate having a first side and a second side;

a non-carbon opaque coloring applied to the first side of the substrate;

a sealant applied over and on top of the non-carbon opaque coloring and the first side of the substrate; and a card base having a first side and a second side and having carbon containing information on the first side thereof, the first side of the substrate being disposed on the first side of the card base and the substrate being and connected to the card base with the non-carbon coloring being disposed over the carbon containing information visually concealing the carbon containing information and the sealant cooperating to adhesively connect the substrate to the card base.

2. The laminated card of claim 1 wherein the substrate is polyester terephthalate.

3. The laminated card of claim 1 wherein the substrate is about 4 mils thick.

4. The laminated card of claim 1 wherein the non-carbon opaque coloring comprises one or more inks with none of the inks containing carbon black pigment.

5. The laminated card of claim 1 wherein the sealant is a copolymer.

6. The laminated card of claim 1 wherein the sealant is ethylene ethyl acrylate copolymer.

7. The strip of laminated card of claim 1 wherein the sealant is about 6 mils thick.

8. A process for making a laminated card from a substrate card base where the card base has carbon containing information thereon comprising:

applying a non-carbon opaque coloring to the substrate;

applying a sealant over the non-carbon opaque coating and over at least a portion of the substrate disposing the substrate on the card base with the sealant being disposed adjacent the card base and with the non-carbon opaque coloring covering and concealing the carbon containing information; and securing the substrate to the card base.

9. The process of claim 8 further comprising:

priming the substrate with a primer before applying the non-carbon opaque coating.

10. The process of claim 8 further comprising:

corona treating the substrate before applying the non-carbon opaque coating.

11. The process of claim 10 further comprising:

corona treating the substrate after applying the sealant.

12. The process of claim 8 wherein the step of applying the sealant further comprises applying the sealant in a thickness of about 6 mils.

13. The process of claim 8 wherein the step of applying the non-carbon opaque coating further comprises applying the non-carbon opaque coloring via silk screening.

14. The process of claim 8 wherein the step of applying the non-carbon opaque coating further comprises applying the non-carbon opaque coloring via flexography.

15. The process of claim 8 wherein the step of securing the substrate to the card base further comprises:

applying heat and pressure.

* * * * *

UNITED STATES PATENT AND TRADEMARK OFFICE

CERTIFICATE OF CORRECTION

PATENT NO. : 5,137,303
DATED : August 11, 1992
INVENTOR(S) : Ronnie E. Goade, et. al.

It is certified that error appears in the above-indentified patent and that said Letters Patent is hereby corrected as shown below:

Column 2, line 31, after the word "coloring", please insert the word --12--.

Column 2, line 60, please delete the word "10" and substitute therefore the word --18--.

Column 3, line 6, please delete the word "t he" and substitute therefore the word --the--.

Column 3, line 21, after the word "that", please insert the word --a--.

Column 3, line 65, please delete the word "aminated" and substitute therefore the word --laminated--.

Column 4, Line 57, after the word substrate, please insert the words

UNITED STATES PATENT AND TRADEMARK OFFICE

CERTIFICATE OF CORRECTION

PATENT NO. : 5,137,303

DATED : August 11, 1992

INVENTOR(S) : Ronnie E. Goade, et. al.

It is certified that error appears in the above-indentified patent and that said Letters Patent is hereby corrected as shown below:

--and a--.

Signed and Sealed this

Nineteenth Day of October, 1993

*Attest:*

Bruce Lehman

BRUCE LEHMAN

*Attesting Officer*

*Commissioner of Patents and Trademarks*